US005222323A

United States Patent [19]

Lundby

[11] Patent Number: 5,222,323

[45] Date of Patent: Jun. 29, 1993

[54] SMOG CONTROL FUEL ADDITIVES

[76] Inventor: William Lundby, 9980 N. Feldman Rd., Marana, Ariz. 85653

[21] Appl. No.: 627,228

[22] Filed: Dec. 14, 1990

[51] Int. Cl.[5] ..... C10L 1/20

[52] U.S. Cl. ..... 44/456; 44/457

[58] Field of Search ..... 44/354, 358, 456, 457

[56] References Cited

U.S. PATENT DOCUMENTS

| | | | |
|---|---|---|---|
| 1,635,216 | 7/1927 | Kettering et al. | 44/457 |
| 2,849,302 | 8/1958 | Lyben | 44/456 |
| 3,084,024 | 4/1963 | Hamilton | 423/219 |
| 3,784,099 | 1/1974 | Bosco | 239/2.1 |
| 4,289,501 | 9/1981 | Medcalf | 44/456 |
| 4,526,584 | 7/1985 | Funk | 44/282 |

FOREIGN PATENT DOCUMENTS

| | | | |
|---|---|---|---|
| 675285 | 7/1952 | United Kingdom | 44/456 |

*Primary Examiner*—Ellen McAvoy

[57] ABSTRACT

Certain chemical elements or compounds, smog inhibitors, added to combustible hydrocarbon-base fuels, can reduce, or eliminate, ozone, $O_3$, an oxidant necessary for the formation of smog and its irritants. A test program demonstrated that atmospheric ozone was reduced an average of about 75% when exhaust gases derived from an automotive engine burning fuel containing an inhibitor were injected into a sealed chamber as compared to the same engine burning fuel containing no additive. In each of the tests using the fuel additive, ozone concentrations approached, or reached, zero for short periods of time, indicating the viability of this method of ozone, and therefore smog, control. This patent is for the purpose of controlling smog formation by the addition of smog inhibitors, such as, but not limited to, iodine or its compounds to hydrocarbon-base fuels prior to, or during, the combustion cycle of these fuels.

1 Claim, 1 Drawing Sheet

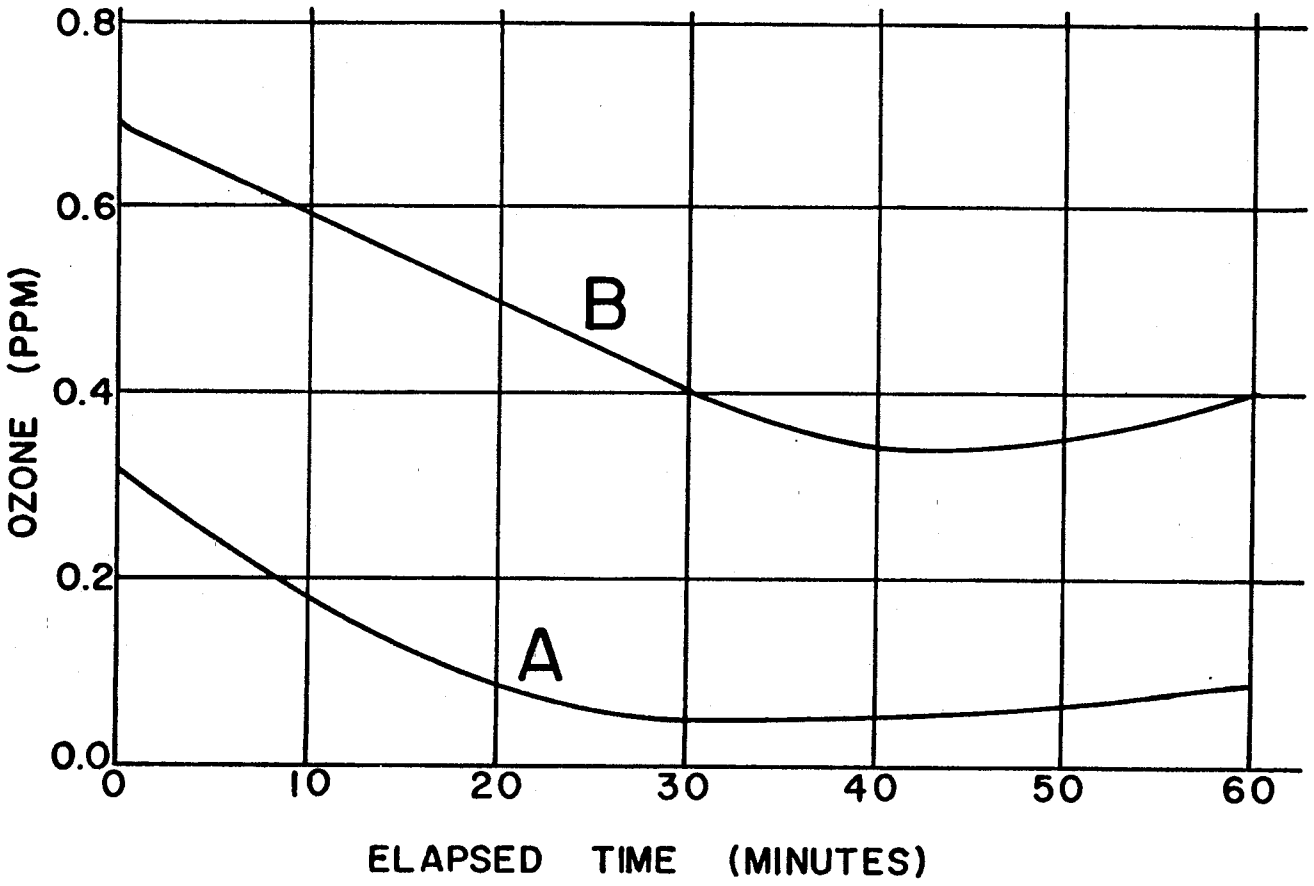
0.8
0.6
0.4
0.2
0.0
OZONE (PPM)
0
10
20
30
40
50
60
ELAPSED TIME (MINUTES)
A
B

SMOG CONTROL FUEL ADDITIVES

SUMMARY OF THE INVENTION

This invention relates to the injection of trace amounts of chemical elements or compounds, inhibitors, into combustible hydrocarbon-base fuels to reduce or eliminate ozone, $O_3$, and consequently, atmospheric pollutants, smog, generated during combustion of these fuels.

A series of tests demonstrated significant reduction of atmospheric ozone in a sealed chamber when minute amounts of methylene iodide were added to automotive fuel and the combustion products injected into the chamber.

It is therefore proposed that smog inhibitors be added directly to hydrocarbon-base fuels prior to combustion in order to aid in the reduction of ozone, and consequently, smog.

BACKGROUND OF THE INVENTION

Smog, a physiological problem for humans, is present in, and adjacent to, most metropolitan and industrialized areas of the world. Smog, and its irritants, are attributed to the photochemical reactions between ozone and products derived from the combustion of hydrocarbon fuels. U.S. Pat. 3,084,024, issued to W. F. Hamilton, et al, and assigned to Lockheed Aircraft of Burbank, Calif., proved that certain chemical elements, or compounds, decrease ozone on the addition of these chemicals into polluted atmosphere. The patent also explained the relationship between ozone and the development of smog and irritants associated with smog, and demonstrated that unreacting chemical inhibitors did not persist in the atmosphere. U.S. Pat. No. 3,784,099, issued to F. N. Bosco of Wheat Ridge, Colo., addressed the problem of smog reduction, and was also based on the addition of chemicals into the atmosphere after the formation of the smog. Because the Lockheed patent proved iodine to be the most effective element to reduce, or prevent the formation of, smog, this current series of tests was conducted using an iodine compound as a fuel additive.

TEST EQUIPMENT AND PROCEDURES

Equipment for the test program consisted of:

1. A 500-cubic foot sealed chamber constructed of aluminum and sealed with non-reactive silicone sealants. The top and sunward-facing, south, wall were 2-mil mylar sheet for maximum exposure of the chamber interior to the sun's ultraviolet radiation.
2. A remanufactured, 4-cylinder automotive engine for the generation of exhaust gases.
3. A Model 03DM-100, S/N 516, ozone monitor manufactured by Ozone Research and Equipment Corporation of Phoenix, Ariz.
4. Recording equipment: Sharp model VHS LV-L 270, VHS camcorder.

In each test, exhaust gases generated during a 5-minute engine run were injected into the sealed chamber. After zeroing and stabilizing the ozone monitor, air from within the chamber was continuously monitored for ozone content for periods of up to 96 minutes. All data were recorded on video, VHS, tapes and evaluated for the tables and figures included in this application. An iodine compound, methylene iodide, $CH_2I_2$, was added to unleaded gasoline for the tests. Two tests, 1 and 2, were run using undiluted methylene iodide added to unleaded gasoline. Four tests, 3 through 6, used a solution containing 1.0 grams methylene iodide per 100 milliliters gasoline, the amount added varying from 32 drops per gallon of fuel, or 1 iodine: 3,500,000 air after combustion, to 8 drops per gallon of fuel, or 1 iodine: 14,000,000 air after combustion.

Two tests, 7 and 8, used no fuel additives and were designed to give an overall background ozone value for the exhaust gases of unleaded gasoline.

SUMMARY OF RESULTS AND CONCLUSIONS

Tables 1–6 tabulate the results of the tests using the fuel additive and Tables 7 and 8 tabulate the results of the tests using no fuel additive. FIG. 1 shows the averaged results of the tests and the effectiveness of the additive for the reduction of atmospheric ozone.

TABLE 1

Date: 8-20-90
Additives: 4 ml. $CH_2I_2$/ gallon unleaded fuel.

| Time (Min) | Ozone (ppm) |
|---|---|
| 0 | 0.36 |
| 1 | .33 |
| 2 | .32 |
| 5 | .24 |
| 6 | .17 |
| 7 | .12 |
| 8 | .10 |
| 9 | .12 |
| 11 | .20 |
| 17 | .14 |
| 18 | .15 |
| 19 | .15 |
| 20 | .155 |
| 21 | .15 |
| 22 | .13 |
| 31 | .08 |
| 32 | .06 |
| 33 | .06 |
| 40 | .015 |
| 41 | .01 |
| 42 | .005 |
| 43 | .015 |
| 54 | .085 |
| 55 | .11 |
| 56 | .10 |
| 57 | .08 |
| 58 | .075 |
| 59 | .105 |
| 73 | .12 |

TABLE 2

Date: 8-20-90
Additives: 0.4 ml. $CH_2I_2$/ gallon unleaded fuel.

| Time (Min) | Ozone (ppm) |
|---|---|
| 0 | 0.57 |
| 1 | .61 |
| 2 | .44 |
| 3 | .375 |
| 4 | .35 |
| 5 | .39 |
| 6 | .425 |
| 7 | .465 |
| 8 | .445 |
| 19 | .10 |
| 21 | .16 |
| 22 | .19 |
| 23 | .095 |
| 24 | .09 |
| 25 | .065 |
| 26 | .04 |
| 27 | .00 |
| 28 | .03 |
| 29 | .02 |

TABLE 2-continued

Date: 8-20-90
Additives: 0.4 ml. $CH_2I_2$/ gallon unleaded fuel.

| Time (Min) | | Ozone (ppm) |
|---|---|---|
| 30 | | .005 |
| 31 | | .02 |
| 32 | | .095 |
| 33 | | .11 |
| 34 | | .105 |
| 35 | | .12 |
| 36 | | .125 |
| 37 | | .13 |
| 38 | | .115 |
| 39 | | .11 |
| 40 | | .12 |
| 52 | | .215 |
| 53 | | .175 |
| 54 | (Fan on) | .06 |
| 55 | | .075 |
| 56 | | .045 |

TABLE 3

Date: 8-20-90
Additives: 32 drops $CH_2I_2$ solution/ gallon unleaded fuel.

| Time (Min) | Ozone (ppm) |
|---|---|
| 0 | 0.32 |
| 1 | .36 |
| 2 | .21 |
| 3 | .21 |
| 4 | .205 |
| 5 | .19 |
| 6 | .13 |
| 7 | .12 |
| 8 | .075 |
| 9 | .01 |
| 10 | .04 |
| 11 | .06 |
| 12 | .07 |
| 13 | .08 |
| 14 | .115 |
| 15 | .11 |
| 16 | .13 |
| 17 | .165 |
| 18 | .12 |
| 25 | .14 |
| 26 | .125 |
| 32 | .045 |
| 33 | .04 |
| 34 | .035 |
| 35 | .02 |
| 36 | .02 |
| 37 | .025 |
| 40 | .07 |
| 50 | .21 |
| 51 | .225 |
| 67 | .08 |
| 68 | .07 |
| 69 | .08 |
| 133 | .10 |
| (Chamber opened) | |
| 141 | .16 |

TABLE 4

Date: 8-20-90
Additives: 16 drops $CH_2I_2$ solution/ gallon unleaded fuel.

| Time (Min) | Ozone (ppm) |
|---|---|
| 0 | 0.395 |
| 1 | .33 |
| 2 | .22 |
| 3 | .15 |
| 4 | .16 |
| 5 | .11 |
| 6 | .01 |
| 7 | .015 |

TABLE 4-continued

Date: 8-20-90
Additives: 16 drops $CH_2I_2$ solution/ gallon unleaded fuel.

| Time (Min) | | Ozone (ppm) |
|---|---|---|
| 8 | | .02 |
| 9 | | .04 |
| 10 | | .10 |
| 11 | | .15 |
| 12 | | .26 |
| 13 | | .23 |
| 14 | | .235 |
| 15 | | .24 |
| 16 | | .24 |
| 19 | | .235 |
| 20 | | .19 |
| 21 | | .13 |
| 22 | | .10 |
| 23 | | .10 |
| 24 | | .125 |
| 25 | | .15 |
| 29 | | .09 |
| 30 | | .08 |
| 35 | | .015 |
| 36 | | .005 |
| 37 | | .095 |
| 41 | | .03 |
| 42 | | .015 |
| 43 | | .125 |
| 48 | | .12 |
| 51 | (Fan on) | .08 |
| 52 | | .045 |
| 53 | | .06 |
| 54 | | .095 |
| 55 | (Fan on) | .14 |
| 56 | | .165 |
| 57 | | .07 |
| 58 | | .05 |
| 59 | | .04 |
| 60 | | .04 |
| 61 | | .03 |
| | (Chamber opened) | |
| 87 | | .115 |
| 88 | | .125 |

TABLE 5

Date: 8-21-90
Additives: 12 drops $CH_2I_2$ solution/ gallon unleaded fuel.

| Time (Min) | Ozone (ppm) |
|---|---|
| 0 | 0.48 |
| 1 | .36 |
| 6 | .49 |
| 7 | .49 |
| 8 | .50 |
| 9 | .43 |
| 10 | .34 |
| 11 | .355 |
| 12 | .315 |
| 13 | .28 |
| 14 | .23 |
| 15 | .22 |
| 16 | .18 |
| 17 | .14 |
| 18 | .105 |
| 19 | .31 |
| 20 | .31 |
| 21 | .22 |
| 22 | .14 |
| 23 | .145 |
| 24 | .20 |
| 25 | .26 |
| 26 | .23 |
| 33 | .035 |
| 34 | .04 |
| 35 | .015 |
| 36 | .005 |
| 37 | .115 |
| 38 | .12 |
| 39 | .14 |

TABLE 5-continued

Date: 8-21-90
Additives: 12 drops $CH_2I_2$ solution/ gallon unleaded fuel.

| Time (Min) | | Ozone (ppm) |
|---|---|---|
| 40 | | 0.145 |
| 41 | | .14 |
| 42 | | .13 |
| 43 | | .095 |
| 44 | | .03 |
| 45 | | .015 |
| 46 | | .01 |
| 47 | | .005 |
| 48 | (Fan on) | .01 |
| 49 | | .02 |
| 50 | | .085 |
| 51 | | .09 |
| 52 | | .07 |
| 53 | | .015 |
| 54 | | .05 |
| 55 | | .09 |
| 56 | | .015 |
| 57 | | .025 |
| 58 | | .025 |
| 59 | | .02 |
| | (Chamber opened) | |
| 60 | | .085 |
| 61 | | .02 |
| 62 | | .04 |
| 63 | (Fan on) | .58 |
| 64 | | 1.26 |
| 69 | | .03 |
| 70 | | .02 |
| 71 | | .07 |
| 72 | | .125 |

TABLE 6

Date: 8-22-90
Additives: 8 drops $CH_2I_2$ solution/ gallon unleaded fuel.

| Time (Min) | Ozone (ppm) |
|---|---|
| 0 | 0.27 |
| 1 | .21 |
| 2 | .23 |
| 3 | .14 |
| 4 | .12 |
| 5 | .03 |
| 6 | .05 |
| 7 | .00 |
| 8 | .06 |
| 9 | .05 |
| 10 | .07 |
| 11 | .095 |
| 12 | .105 |
| 13 | .06 |
| 14 | .05 |
| 15 | .04 |
| 16 | .04 |
| 17 | .04 |
| 18 | .06 |
| 19 | .09 |
| 20 | .11 |
| 21 | .085 |
| 22 | .07 |
| 23 | .05 |
| 24 | .035 |
| 25 | .005 |
| 26 | .00 |
| 27 | .01 |
| 28 | .005 |
| 29 | .015 |
| 30 | .02 |
| 31 | .04 |
| 32 | .055 |
| 33 | .065 |
| 34 | .09 |
| 35 | .105 |
| 36 | .11 |
| 37 | .12 |
| 38 | .145 |

TABLE 6-continued

Date: 8-22-90
Additives: 8 drops $CH_2I_2$ solution/ gallon unleaded fuel.

| Time (Min) | Ozone (ppm) |
|---|---|
| 39 | .125 |
| 40 | .115 |
| 41 | .09 |
| 42 | .11 |
| 43 | .125 |
| 44 | .15 |
| 45 | .17 |

TABLE 7

Date: 8-16-90
Additives: No additives; unleaded fuel.

| Time (Min) | Ozone (ppm) |
|---|---|
| 0 | 0.75 |
| 1 | .56 |
| 2 | .36 |
| 6 | .55 |
| 7 | .45 |
| 9 | .47 |
| 11 | .55 |
| 13 | .60 |
| 14 | .55 |
| 15 | .70 |
| 17 | .60 |
| 18 | .50 |
| 19 | .50 |
| 20 | .45 |
| 21 | .35 |
| 24 | .40 |
| 25 | .50 |
| 26 | .50 |
| 29 | .40 |
| 30 | .30 |
| 51 | .50 |
| 57 | .55 |
| 58 | .55 |
| 60 | .45 |
| 64 | .38 |
| 65 | .45 |
| 80 | .70 |
| 82 | .65 |
| 83 | .62 |
| 85 | .63 |
| 87 | .875 |
| 89 | .875 |
| 90 | .875 |
| 91 | .875 |
| 92 | .875 |
| 94 | .925 |
| 96 | .975 |

TABLE 8

Date: 8-21-90
Additives: No additives; unleaded fuel.

| Time (Min) | Ozone (ppm) |
|---|---|
| 0 | 0.955 |
| 1 | .69 |
| 7 | .78 |
| 8 | .705 |
| 9 | .59 |
| 10 | .56 |
| 11 | .61 |
| 12 | .605 |
| 13 | .57 |
| 14 | .48 |
| 15 | .52 |
| 16 | .53 |
| 17 | .55 |
| 18 | .585 |
| 19 | .58 |
| 20 | .565 |

TABLE 8-continued

| Date: 8-21-90 Additives: No additives; unleaded fuel. | | |
|---|---|---|
| Time (Min) | | Ozone (ppm) |
| 21 | | .56 |
| 22 | | .55 |
| 23 | | .50 |
| 24 | | .50 |
| 27 | | .485 |
| 28 | | .465 |
| 29 | | .455 |
| 30 | | .43 |
| 35 | | .285 |
| 36 | | .295 |
| 37 | | .32 |
| 38 | | .34 |
| 39 | | .435 |
| 40 | (Fan on) | .41 |
| 41 | | .37 |
| 42 | | .395 |
| 43 | | .39 |
| 46 | | .325 |
| 47 | | .26 |
| 48 | | .215 |
| 49 | | .22 |
| 50 | | .31 |
| 51 | | .335 |
| 52 | | .36 |
| 53 | | .34 |
| 54 | | .30 |
| 55 | | .30 |
| 56 | | .32 |
| 57 | | .31 |
| 58 | | .30 |
| 59 | | .30 |
| 60 | | . |

Methylene iodide, when added directly to automotive fuel, measurably and appreciably reduced or eliminated ozone generated during smog-forming atmospheric conditions. The iodine, in a concentration of as little as 1:14,000,000 in the atmosphere, proved effective as an ozone inhibitor.

U.S. Pat. No. 3,084,024 demonstrated that similar results can be attained using other halides, volatile amines, and hydroquinones, and therefore these, and other, elements or compounds can be added to hydrocarbon-base fuels, natural or synthetic, to aid in the alleviation of smog and its effects. More complex ring structure hydrocarbons, such as iodooctane or iodopentane, can be expected to be more miscible with gasoline and at least as effective as methylene iodide for ozone reduction.

Comparable effects predictably are attainable using similar or related smog inhibitors combined with, or misted into the combustion chambers of, solid fossil or hydrocarbon fuels, such as coal.

What is claimed is:

1. A method of controlling, reducing or eliminating, ozone and related smog resulting from photochemical reactions between ozone and automotive or industrial gases comprising the addition of iodine or compounds of iodine to hydrocarbon-base fuels prior to or during combustion in an amount of about 1 part iodine per 240 to 10,000,000 parts fuel, by weight, to be accomplished by:

a. the addition of these inhibitors during or after the refining or manufacturing process of liquid fuels;

b. the production of these inhibitors for addition into fuel tanks, such as automotive or industrial tanks; or c. the addition of these inhibitors into combustion chambers of equipment utilizing solid fuels for the purpose of reducing ozone.

* * * * *